United States Patent [19]

Lyden

[11] Patent Number: 4,674,206

[45] Date of Patent: Jun. 23, 1987

[54] MIDSOLE CONSTRUCTION/SHOE INSERT

[76] Inventor: Robert M. Lyden, 600 LaBore Rd., St. Paul, Minn. 55117

[21] Appl. No.: 714,626

[22] Filed: Mar. 21, 1985

[51] Int. Cl.[4] ..... A43B 13/18

[52] U.S. Cl. ..... 36/88; 36/28; 36/43

[58] Field of Search ..... 36/43, 44, 88, 29, 28, 36/69, 71, 37; 12/142 N, 146 M

[56] References Cited

U.S. PATENT DOCUMENTS

| | | | |
|---|---|---|---|
| 873,722 | 12/1907 | Cohen | 36/37 |
| 2,123,730 | 6/1938 | Huttleston | 36/71 |
| 2,546,827 | 3/1951 | Lavinthal | 36/71 |
| 2,764,134 | 9/1956 | Town | 36/71 |
| 2,865,097 | 12/1958 | Vollrath, Jr. et al. | 36/44 X |
| 3,121,430 | 2/1964 | O'Reilly | 128/595 |
| 3,266,178 | 8/1966 | Gilkerson | 36/43 |
| 3,407,406 | 10/1968 | Werner | 2/3 |
| 3,449,844 | 6/1969 | Spence | 36/44 |
| 3,530,173 | 7/1970 | Jesinsky | 36/37 X |
| 3,736,673 | 6/1973 | Dubner | 36/44 |
| 3,809,224 | 5/1974 | Greenwood | 206/219 |
| 3,892,077 | 7/1975 | Wolstenholme | 36/44 |
| 3,968,577 | 7/1976 | Jackson | 36/43 |
| 3,985,853 | 10/1976 | Weisberg | 264/250 |
| 4,006,542 | 2/1977 | Larson | 36/43 |
| 4,123,855 | 11/1978 | Thedford | 36/43 |
| 4,124,946 | 11/1978 | Tomlin | 36/43 |
| 4,128,951 | 12/1978 | Tansill | 36/44 |
| 4,211,019 | 7/1980 | McCafferty | 36/43 |
| 4,237,626 | 12/1980 | Brown | 36/43 |
| 4,340,626 | 7/1982 | Rudy | 36/43 X |
| 4,346,205 | 8/1982 | Hiles | 528/53 |

*Primary Examiner*—Werner H. Schroeder
*Assistant Examiner*—T. Graveline

[57] ABSTRACT

A midsole construction or insert 20 comprising a two-part composition 41 and entrapped air cushion 40 is employed within an article of footwear 44 in order to enhance conformance, stability and comfort. Said composition 41 and entrapped air 40 are contained within a bi-pac of suitable configurations. The removal of a restraining pin 24 permits the reagents to mix freely and set in conformance with the wearer's foot 28 after insertion into an article of footwear 44. The midsole construction or insert 20 is configured to underlie the area of the heel 30 and extend to just short of the metatarsal heads 32, thus achieving conformance and stabilizing the heel 30 and arch(es) of the foot 28. The entrapped air 40 is configured to underlie the apex of the arch(es) 34 so as to accomodate their dynamic movement.

19 Claims, 10 Drawing Figures

MIDSOLE CONSTRUCTION/SHOE INSERT

FIELD OF THE INVENTION

This invention relates generally to the field of insoles, and midsole constructions which may be caused to conform to the foot of the wearer.

BACKGROUND OF THE INVENTION

Many individuals, and in particular many athletes, possess serious podiatric conditions and thus require the manufacture of prescription orthotics. But many of the problems commonly encountered stem from inadequate conformance, support and stability. Here, the midsole or insole of the shoe often prove inadequate. Every individual has a different set of feet. The problem to be solved: How to accomodate individual differences and thus provide superior conformance, stability and comfort in a mass produced article of footwear?

There have been a number of attempted solutions to this problem which have enjoyed varied success. Obvious merits aside, some of the deficiencies of the prior art will be briefly addressed.

As mentioned above, orthotics are sometimes required to correct serious podiatric conditions. For some individuals there is no practical alternative. But orthotics take considerable time for a specialist to fabricate and are thus relatively expensive. They are neither a viable practical alternative, nor truly necessary for the general public. Moreover, many orthotic devices are rigid and do not permit adequate flexion of the arch(es). Orthotics are seldom fixed within the shoe in a manner that would prevent their slipping about. Such movement produces discomfort for the wearer and partially nullifies the corrective value of the orthotic. Furthermore, the insertion of an orthotic device will often change the conforming properties of the last of the shoe resulting in poor fit and discomfort.

Pre-formed insoles of various kinds accomodate a greater, or lesser number of individuals depending upon the incorporation of characteristic norms in their design. But as every individual has a different set of feet, a pre-formed insole will not accomodate every individual to the same degree.

There have been a number of attempts to introduce deformable, or elastomeric materials into the midsole, or insole of an article of footwear so as to provide a "custom" fit for any given individual. The present invention would fall into this category. Some of the prior art designs have proven inadequate because of improper design, or application. For example, reference is made to foot supports which are made of elastomeric material(s) and which underlie the entire foot (in particular, the area forward of the metatarsals). In the practical application such would induce serious biomechanical complications.

Reference is also made to attempts to introduce such quantity of elastomeric material(s) as to alter the foot's proper conformance with the last of the shoe.

In addition, some inventors have wanted for suitable elastomeric materials that would set to the desired consistency during a convenient time period. Others, possessing such materials, have not adequately dealt with the problem posed by exothermic (heat producing) reactions. Few inventors have made an attempt to accomodate the flexion of the arch(es), and many have suggested means that have proven largely impracticable. And few inventors have thought to provide a means of construction and adhesion that would permit easy removal and replacement of an accomodative device.

There have also been a number of ideas as to how to introduce and contain elastomeric material(s) within an article of footwear. Many have thought to inject the material by various means, whereas others have thought to otherwise contain, or enclose the same. The procedures and methods to be associated with these attempts have for the most part been relatively complex, time consuming, expensive, or otherwise not amenable to mass production and use by the general public. In fact, it is perceived that these shortcomings are responsible for the failure of the leading manufacturers of footwear to incorporate a midsole construction, or insert employing elastomeric material(s).

SUMMARY OF THE INVENTION

Accordingly, the present invention includes a method and apparatus for conforming to and supporting a foot. An apparatus of the present invention includes a footwear insert suitable for inserting into an article of footwear and conforming to and supporting a foot, including a pliable casing forming an inner volume; and a resilient material contained within the casing and displacing a portion of the inner volume, wherein a void is formed within the casing and the void and the resilient material are suitable for conforming to and supporting the foot when the insert is suitably positioned within the article of footwear.

In a preferred embodiment of the apparatus of the present invention, the insert underlies the arch of the foot and extends from the heel to just short of the metatarsal heads of the foot.

In preferred embodiments the resilient material referred to above includes an elastomer. Also, preferably, the elastomer is a two-part polyurethane.

In addition, in preferred embodiments the casing is larger than the resilient material such that a void is formed wherein the void is suitable for positioning proximate to the arch of the foot atop the resilient material. The void assists in conforming to and supporting the foot.

Preferred embodiments also include a wedge suitable for supporting the heel of the foot.

The present invention also includes a footwear insert including:

(a) a pliable casing defining first and second bags;

(b) a pin operatively connected to the casing separating the first and second bags, and selectively preventing fluid communication therebetween;

(c) a first reagent contained within the first bag; and (d) a second reagent contained within the second bag, wherein when the pin is removed from operative contact with the casing the first and second bags are placed in fluid communication and the first and second reagents mix to form a resilient material suitable for conforming to and supporting the foot.

Preferred embodiments of such a footwear insert include the various features listed above.

The present invention also includes a method for supporting a foot. The method includes the following steps:

(a) selecting an article of footwear suitable for containing and underlying the foot;

(b) selecting a pliable casing;

(c) separating the pliable casing into first and second bags so that the first and second bags are not in fluid communication with each other;

(d) placing a first reagent within the first bag;

(e) placing a second reagent within the second bag;

(f) placing the first and second bags in fluid communication to thereby allow said reagents to mix to form a composition;

(g) positioning the composition contained within the casing within the article of footwear; and (h) positioning the foot within the article of footwear while allowing the composition to cure to form a resilient composition suitable for conforming to and supporting the foot.

Preferably, the method of the present invention includes forming a void within the casing wherein the void is suitable for positioning proximate to the arch of the foot and conforming to and supporting the foot. That is, the casing is preferably larger than the resilient material so as to form a void wherein the void naturally rises to the top portion of the casing and is suitable for cushioning the arch of the foot.

DETAILED DESCRIPTION OF THE INVENTION

Figure 1:
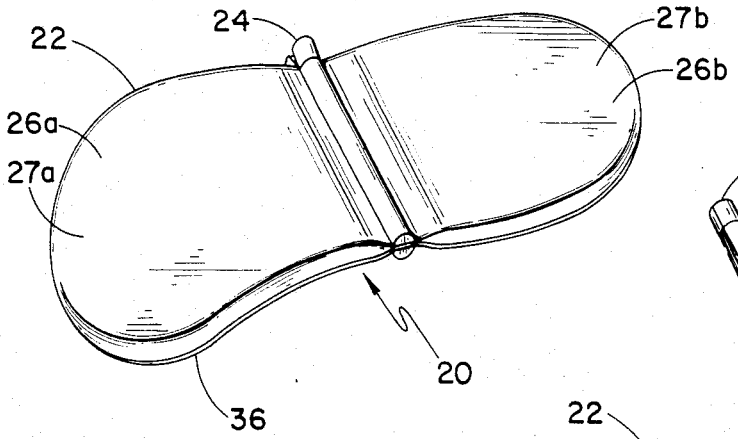
FIG. 1 is a perspective view of an uncatalized bi-pac insert of the present invention showing the restraining pin and the initial separation of the two reagents.

Referring to the figures, wherein like reference numerals represent like parts throughout the several views, a preferred insert 20 is shown in its original state in FIG. 1. The insert 20 is preferably composed of a clear pliable polyethylene outer casing 22 approximately ten mils in thickness enabling the status of is contents to be plainly seen. Generally, the casing 22 should be a durable material able to withstand the pressure of a person's body weight being placed upon its contents prior to setting.

The preferred polyethylene casing 22 is heat/pressure sealed using conventional techniques so as to render the insert 20 a completely self-enclosed unit. Within the insert 20 is preferably a two-part composition. A restraining pin 24 initially separates the two reagents *27a, 27b*. Each reagent is contained within a separate bag *26a, 26b*, one reagent *27a* being stored in bag *26a* and one reagent *27b* being stored in bag *26b*. When the restraining pin 24 is removed the bags *26a, 26b* are placed in fluid communication and the reagents *27a, 27b* are free to interact within the larger polyethylene casing 22. The low viscosity of the reagents facilitates their proper mixture.

The preferred elastomeric material or composition which is initially stored as two separate components *27a, 27b* in bags *26a* and *26b* is a two-part resilient polyurethane, "UR-2152" a product of the H. B. Fuller Company, although other two-part elastomers are contemplated. One reagent or component *27a* is a resin and may be stored initially in bag *26a;* the other reagent *27b* is a curing agent and may be stored in bag *26b*.

Further with regard to the preferred two-part elastomer, the setting time of the reagents and hardness of the final composition 41 (see FIG. 5) should be selected according to certain criteria. A setting time of approximately ten minutes at room temperature is generally sufficient for the completion of necessary procedures described below. The hardness of the cured composition 41 should preferably not be less than that of the midsole material commonly being employed by the leading manufacturers of athletic shoes. This is normally in the range of 40–60 Shore D.

Thus the cured composition 41 is resilient, acting to absorb shock and conform to the wearer's foot. One reason that polyurethane is preferred is that the exothermic reaction which typically accompanies the curing process is not severe and the heat generated during reaction stays within tolerable bounds. The working temperature of "UR-2151" is between 65°–120° F. It should also be noted that the insert 20 preferably underlies the insole proper which serves to insulate the wearer's foot from the exothermic reaction.

The other material being employed within the midsole construction or insert 20 is an entrapped gas, preferably air. The quantity of reagents *27a, 27b* and entrapped air introduced within the bags *26a, 26b* can be regulated during production. Any entrapped air naturally rises to the highest point(s) within the insert 20. This will invariably correspond to the apex of the arch(es) 34 once the insert 20 is activated, inserted into an article of footwear 44 and deformed in conformance with the wearer's foot. This entrapped air "cushion" 40 (see FIG. 5) within the insert 20 accomodates the dynamic movement of the arch(es) in the precise area where such movement occurs. It may be desirable to introduce a reinforced, or specially designed chamber (not shown) within the midsole construction, or insert 20 to ensure the proper containment of the entrapped air "cushion" 40.

Figure 5:
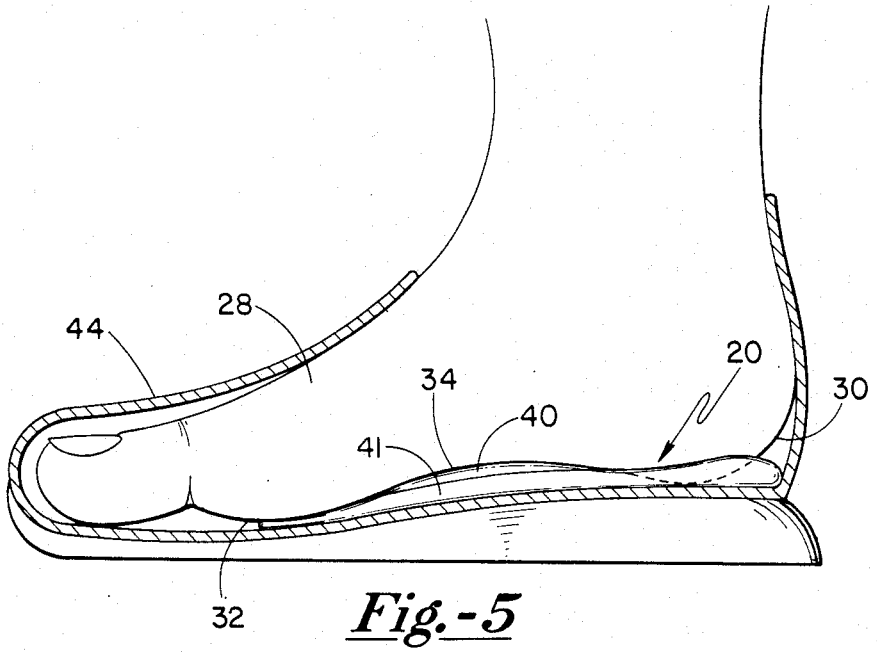
FIG. 5 is a side view of the bi-pac insert of FIG. 3 installed in a shoe with a foot in position.
Figure 6:
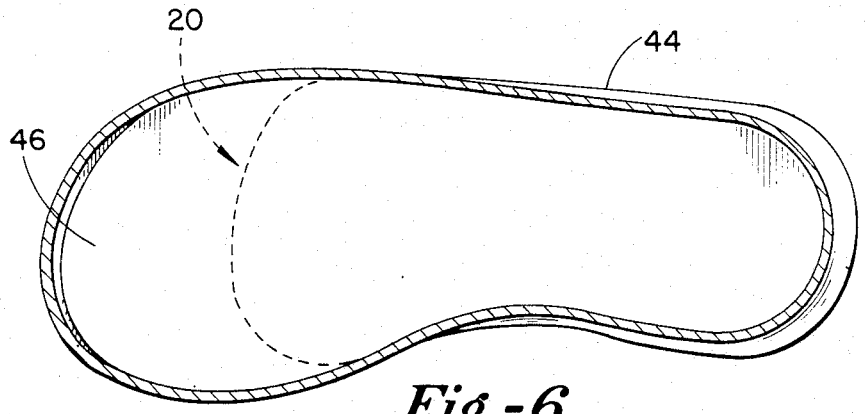
FIG. 6 is a top view of the bi-pac of FIG. 3 and overlying insole-proper of FIG. 4 installed in the shoe.

As shown in FIG. 5, insert 20 preferably underlies the plantar side of the foot 28 and extends from the area of the heel 30 to just short of the metatarsal heads 32 thus supporting the arch(es) 34 of the foot 28. Ideally, the insert 20 should be designed in conformance with the last of the shoe 44, or article of footwear in which the application is to be made. The insert 20 will then vary as to both length and width depending upon the size and configuration of the particular application. The amount of elastomeric material present within an insert 20 designed for a given application could be regulated so as to accomodate for differing arch characteristics; e.g. "high," "normal," and "low" arches, or so-called flat feet.

Figure 3:
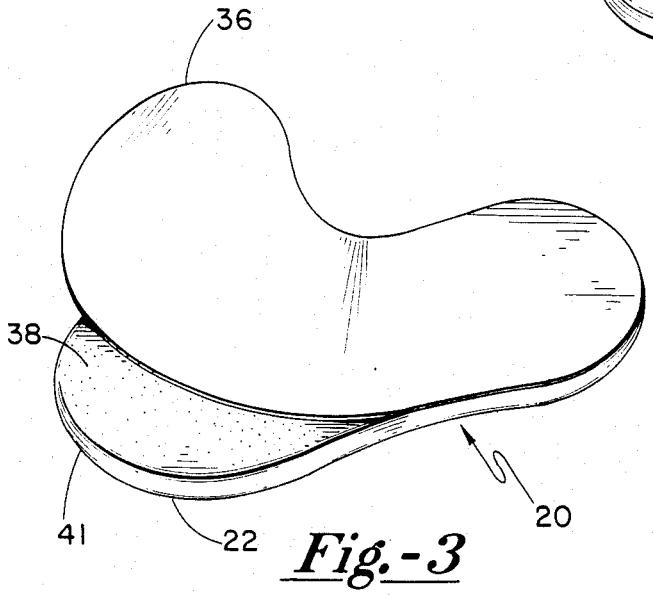
FIG. 3 is a perspective view of the insert of FIG. 1 illustrating the removal of the protective strip on the underside of the bi-pac insert exposing a self-adhesive surface.

One side of the insert 20 may employ a peel-away protective backing 36 that exposes a self-adhesive surface 38 (see FIG. 3). The adhesive being used at the present time is a "Pressure Sensitive" product of the H. B. Fuller Company. Such an adhesive will permit easy removal and replacement of the insert if ever necessary.

Figure 7:
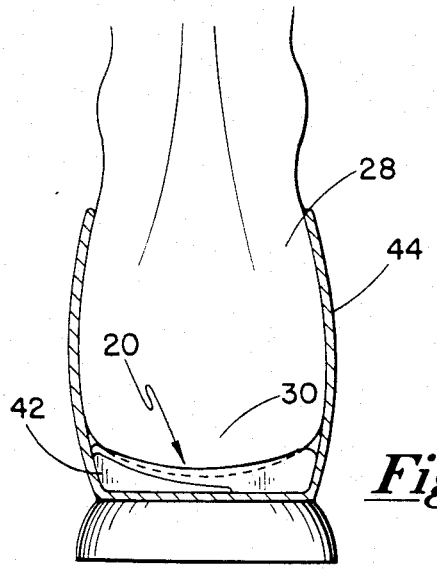
FIG. 7 is a rear view of a corrective wedge being used in conjunction with the bi-pac insert of FIG. 3.
Figure 8:
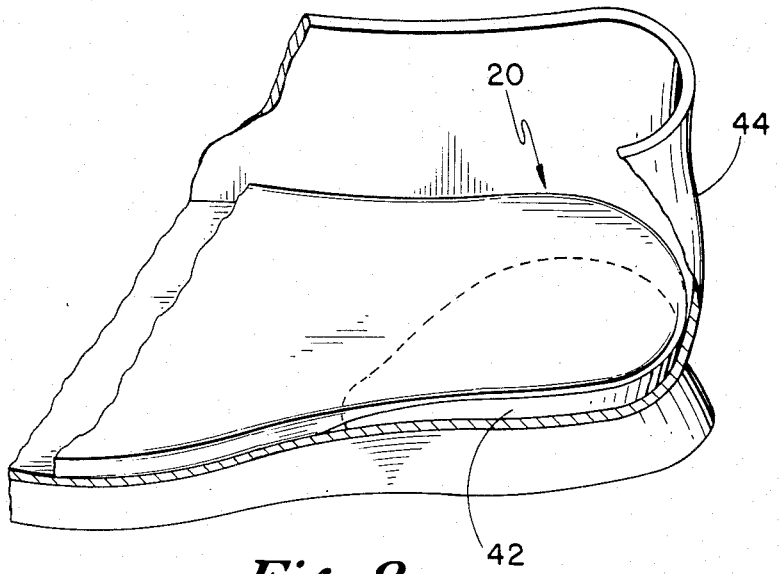
FIG. 8 is a side view perspective of a corrective wedge being used in conjunction with the bi-pac insert of FIG. 3.

Referring to FIGS. 7 and 8, it would also be possible to introduce corrective "wedges" 42 to accomodate podiatric deviations that would fall outside the norm, e.g., the conditions of pronation, supination, varus, and valgus. These "wedges" 42 could be manufactured to specified degress of correction for the particular article of footwear in which the application would be made. Again, a protective backing (not shown) could be removed from the "wedge" to expose a self-adhesive surface. The introduction of such corrective devices should generally be undertaken with the supervision of a skilled and knowledgeable podiatrist.

Figure 2:
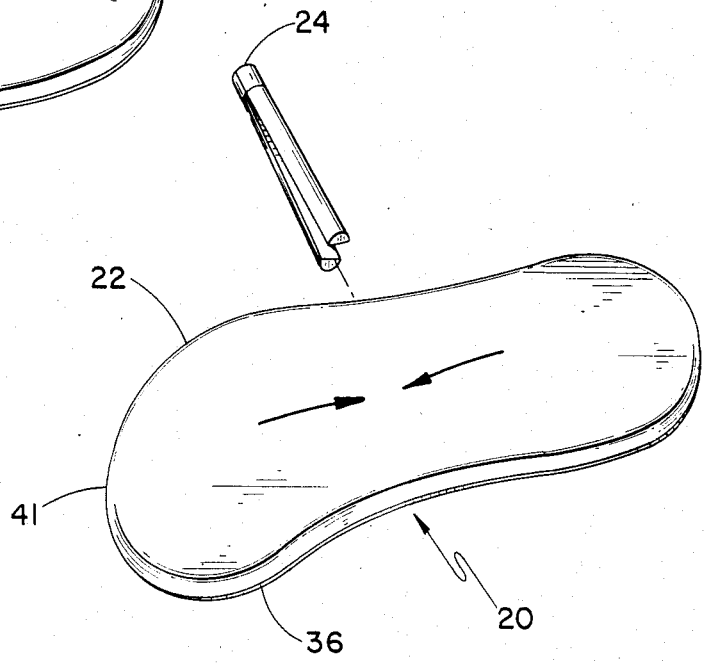
FIG. 2 is a perspective view of the insert of FIG. 1 showing the removal of the restraining pin and mixing of the bi-pac's reagents.
Figure 4:
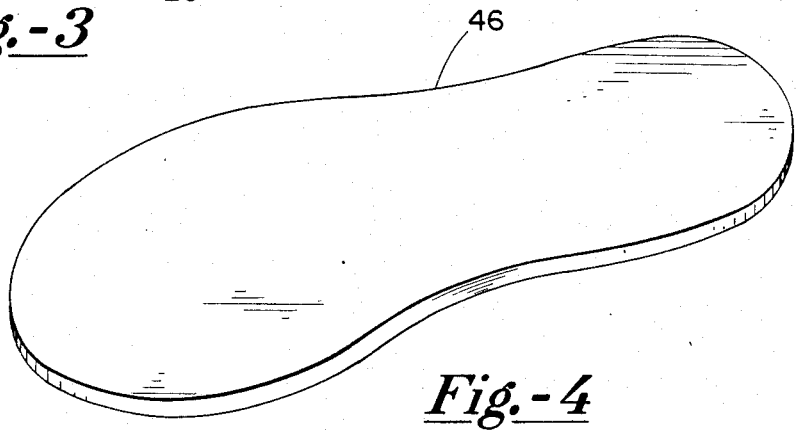
FIG. 4 is a perspective view of an insole-proper composed of SPENCO, SORBOTHANE, or other like suitable material(s).
Figure 9:
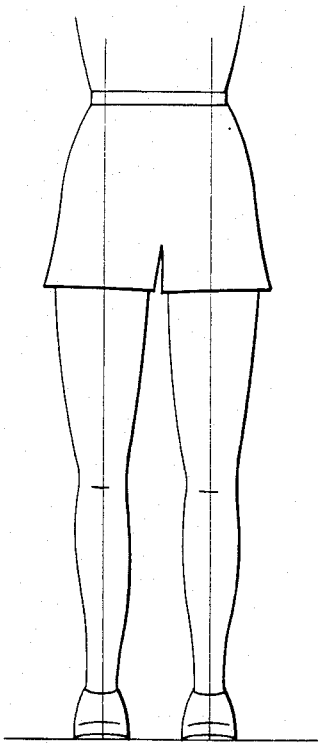
FIG. 9 is a front view illustrating proper bodily alignment in the neutral position.
Figure 10:
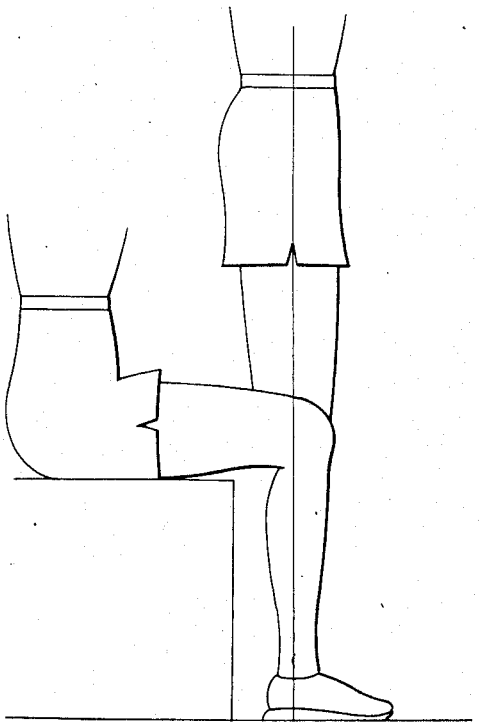
FIG. 10 is a side view demonstrating proper bodily alignment in two neutral positions.

The procedure for employing insert 20 can now be described with reference to the Figures. As shown in FIG. 2, the restraining pin 24 is removed to permit the reagents 27*a*, 27*b* in bags 26*a*, 26*b* to mix freely. The insert 20 is then kneaded as necessary. Mixing is easily accomplished because of the preferred low viscosity of the reagents 27 and can be verified visually. Once the reagents have been thoroughly mixed, the protective strip 36 is removed from the polyethylene bag 22, thus exposing its self-adhesive surface 38. The "activated" insert 20 is then inserted into the article of footwear 44. The insole proper 46, shown in FIG. 4, is then inserted into the article of footwear 44. Most desirable is an insole of SPENCO, or SORBOTHANE, but other like materials would be acceptable provided that they would assume proper continuity. The foot 28 is then inserted into and secured within the article of footwear 44. The two-part elastomer 41 is preferably such that it should be possible to walk upon the shoe 44 for a short time. However, it is important that the wearer stand, or sit relatively motionless as the activated bi-pac insert 20 sets or cures. Under normal conditions at room temperature this will occur between 8–12 minutes after the reagents 27*a*, 27*b* have been mixed. For preferred two-part polyurethanes in athletic applications the inventor considers that the insert 20 should set with the wearer maintaining a standing position, the reason being to better accomodate the flexion of the arch(es) 34. But whether the insert 20 be deformed and set in a standing, or sitting position the alignment of the wearer's leg and foot should correspond to the "neutral position" i.e. the lower leg (tibia) should be roughly perpendicular to the surface upon which the article of footwear rests: the knee joint should be directly above the ankle joint and its alignment with respect to the foot should be such that the knee (patella) is in line with the second toe, or middle of the fore-foot. The conditions of pronation, or supination will thus be avoided. FIGS. 9 and 10 illustrate standing and sitting neutral positions.

As noted above, it would be possible to correct podiatric conditions by introducing pre-formed "wedges" 42, or devices incorporating the necessary correction in conjunction with the insert 20. These would preferably be suitably affixed to the underside of the bi-pac insert 20 prior to its insertion into an article of footwear 44.

I claim:

1. A footwear insert for inserting into an article of footwear and conforming to and supporting a foot, comprising:

(a) a pliable casing forming an inner volume; and (b) a resilient material contained within said casing and displacing a portion of said inner volume, wherein a void is formed within said casing and is displaced to a position closest to the foot and wherein said resilient material underlies said void and said void and said resilient material conform to and support the foot when said insert is positioned within the article of footwear when pressure is applied by the foot.

2. The footwear insert according to claim 1, wherein the foot has a heel, an arch, and metatarsal heads, and said insert underlies the arch and extends from the heel to just short of the metatarsal heads.

3. The footwear insert according to claim 1, wherein said resilient material comprises an elastomer.

4. The footwear insert according to claim 3, wherein said elastomer comprises a polyurethane.

5. The footwear insert according to claim 4, wherein said polyurethane is a two-part polyurethane.

6. The footwear insert according to claim 1, wherein said casing comprises a polyethylene material.

7. The footwear insert according to claim 1, wherein said void is substantially filled with a gas.

8. The footwear insert according to claim 1, wherein said footwear insert further comprises an adhesive layer operatively connected to the outside of said pliable casing, wherein said footwear insert is configured for removably attaching to the article of footwear.

9. The footwear insert according to claim 1, wherein the foot has a heel, and wherein said footwear insert further comprises a wedge suitable for supporting the heel of the foot.

10. A footwear insert for inserting into an article of footwear and conforming to and supporting a foot, comprising:

(a) a pliable casing defining first and second bags and containing a predetermined amount of gas;

(b) a pin operatively connected to said casing separating said first and second bags, and selectively preventing fluid communication therebetween;

(c) a first reagent contained within said first bag; and (d) a second reagent contained within said second bag, wherein when said pin is removed from operative contact with said casing said first and second bags are placed in fluid communication and said first and second reagents mix to form a resilient material conforming to and supporting the foot when pressure is applied by the foot.

11. The article of footwear according to claim 10, wherein said resilient material comprises an elastomer.

12. The footwear insert according to claim 11, wherein said elastomer comprises a polyurethane.

13. The footwear insert according to claim 12, wherein said polyurethane is a two-part polyurethane.

14. The footwear insert according to claim 10, wherein said casing comprises a polyethylene material.

15. The footwear insert according to claim 10, wherein a void is formed between said resilient material and said casing.

16. The footwear insert according to claim 15, wherein said void is substantially filled with a gas.

17. The footwear insert according to claim 16, wherein said void is positioned closest to the foot, and wherein said resilient material underlies said void.

18. A method for supporting a foot, comprising:

(a) selecting an article of footwear containing and underlying the foot;

(b) selecting a pliable casing and adding a predetermined amount of gas;
(c) separating said pliable casing into first and second bags so that said first and second bags are not in fluid communication with each other;
(d) placing a first reagent within said first bag;
(e) placing a second reagent within said second bag;
(f) placing said first and second bags in fluid communication to thereby allow said reagents to mix to form a composition;
(g) positioning said composition contained within said casing within said article of footwear; and
(h) positioning the foot within said article of footwear while allowing said composition to cure to form a resilient composition conforming to and supporting the foot.

19. The method according to claim 18, wherein the foot has an arch, wherein a void is formed between said resilient composition and said casing, said void overlying said resilient composition when said casing is positioned within an article of footwear, and wherein said void is proximate the arch of the foot when the foot is positioned within said article of footwear.

* * * * *